US009774138B1

(12) United States Patent
Peng

(10) Patent No.: US 9,774,138 B1
(45) Date of Patent: Sep. 26, 2017

(54) CONNECTOR MODULE

(71) Applicant: F TIME TECHNOLOGY INDUSTRIAL CO., LTD., New Taipei (TW)

(72) Inventor: Chang-Lin Peng, New Taipei (TW)

(73) Assignee: F TIME TECHNOLOGY INDUSTRIAL CO., LTD., New Taipei (TW)

( * ) Notice: Subject to any disclaimer, the term of this patent is extended or adjusted under 35 U.S.C. 154(b) by 0 days.

(21) Appl. No.: 15/368,641

(22) Filed: Dec. 4, 2016

(51) Int. Cl.

| | |
|---|---|
| ***H01R 13/502*** | (2006.01) |
| ***H01R 13/631*** | (2006.01) |
| ***H01R 24/20*** | (2011.01) |
| ***H01R 24/28*** | (2011.01) |
| ***H01R 13/04*** | (2006.01) |
| ***H01R 13/10*** | (2006.01) |
| ***H01R 13/645*** | (2006.01) |
| ***H01R 13/627*** | (2006.01) |
| *H01R 107/00* | (2006.01) |

(52) U.S. Cl.
CPC ..... *H01R 13/631* (2013.01); *H01R 13/04* (2013.01); *H01R 13/10* (2013.01); *H01R 13/502* (2013.01); *H01R 13/6272* (2013.01); *H01R 13/645* (2013.01); *H01R 24/20* (2013.01); *H01R 24/28* (2013.01); *H01R 2107/00* (2013.01)

(58) Field of Classification Search
CPC .. H01R 13/6275; H01R 13/20; H01R 13/639; H01R 13/6272; H01R 2103/00; H01R 13/514
USPC ..... 439/345–347, 352–355, 357, 695, 701
See application file for complete search history.

(56) References Cited

U.S. PATENT DOCUMENTS

| | | | | |
|---|---|---|---|---|
| 6,116,945 | A * | 9/2000 | Davis | H01R 13/5825 439/354 |
| 6,764,350 | B2 * | 7/2004 | Kosmala | H01R 9/032 439/598 |
| 7,044,789 | B2 * | 5/2006 | Yohn | H01R 13/6592 439/599 |
| 7,967,629 | B1 * | 6/2011 | Liu | H01R 13/6272 439/354 |
| 7,976,330 | B2 * | 7/2011 | Lin | H01R 4/4818 439/353 |
| 8,235,744 | B1 * | 8/2012 | Liptak | H01R 13/639 439/352 |
| 8,591,247 | B2 * | 11/2013 | Zhu | H01R 13/6273 439/352 |
| 8,715,016 | B2 * | 5/2014 | DeBock | H01R 13/514 439/701 |
| 8,840,435 | B2 * | 9/2014 | Plazio | H01R 13/506 439/607.41 |

(Continued)

*Primary Examiner* — Thanh Tam Le
(74) *Attorney, Agent, or Firm* — Guice Patents PLLC

(57) ABSTRACT

A connector module includes a connection housing including an adapter portion, a through slot cut through the adapter portion, a plurality of claws suspending inside the adapter portion and a retaining groove disposed inside the adapter portion, and a lead wire holder assembly including a guide tube inserted into the through slot of the connection housing, an endless groove extended around the periphery of the guide tube and forced into engagement with the claws of the connection housing, a locating block located on the guide tube and positioned in the retaining groove of the connection housing and a lead wire module fastened to the guide tube to hold lead wires inside the guide tube.

17 Claims, 8 Drawing Sheets

(56) References Cited

U.S. PATENT DOCUMENTS

| | | | | |
|---|---|---|---|---|
| 8,944,839 | B2 * | 2/2015 | Pfeiffer | H01R 13/6275 439/352 |
| 8,974,243 | B2 * | 3/2015 | Friese | H01R 13/4367 439/374 |
| 9,039,438 | B2 * | 5/2015 | Gunreben | H01R 13/6273 439/352 |

* cited by examiner

CONNECTOR MODULE

BACKGROUND OF THE INVENTION

1. Field of the Invention

The present invention relates to connector technology and more particularly, to a connector module, which has claws arranged in a connection housing for securing a lead wire holder assembly to facilitate the assembly process.

2. Description of the Related Art

With the continuous updating of electronic technology, electronic innovative products have been continuously created. Various electronic products are connected to other electronic devices by cable with mating male and female connectors for signal transmission.

A male or female connector generally comprises a connection housing, and a guide tube mounted in the connection housing to hold lead wires for conduction. The connection housing is formed of two half shells fastened together by means of a butt joint to hold down the guide tube therein for the connection of the mating female or male connector.

However, the two half shells of the connection housing can easily get loosened, affecting connection between the mating male and female connectors. Some other prior art designs employ a socket joint connection method to achieve connection between the connection housing and the guide tube, eliminating the connection instability problem of the aforesaid butt joint. However, this socket joint connection method cannot lock the connection housing and the guide tube in position. The connection housing and the guide tube can be displaced relative to each other. An improvement in this regard is desired.

SUMMARY OF THE INVENTION

The present invention has been accomplished under the circumstances in view. It is one object of the present invention to provide a connector module, which uses claws for engagement with an endless groove around the periphery of a guide tube to secure lead wire holder assembly to a connection housing tightly, facilitating the assembly process.

To achieve this and other objects of the present invention, a connector module comprises a connection housing, a lead wire holder assembly, and a male connector. The connection housing comprises a through slot axially cut through opposing front and rear sides thereof, an adapter portion located at the rear side around the through slot, a plurality of claws spaced around an inside wall of the adapter portion and respectively defined with the inside wall of the adapter portion a predetermined contained angle, and a retaining groove located on the inside wall of the adapter portion. The lead wire holder assembly is inserted into the through slot of the connection housing, comprising a holder shell and a lead wire module inserted into the holder shell. The holder shell comprises a guide tube. The guide tube comprises an endless groove extended around the periphery thereof and forced into engagement with the claws of the connection housing, and a locating block located thereon adjacent to the endless groove and positioned in the retaining groove of the connection housing. The lead wire module comprises a locating seat inserted into the guide tube. The locating seat comprises a plurality of longitudinally extended through slots adapted for holding respective lead wires, a wrapping block comprising a locating plate, two cover plates respectively hinged to two opposite sidewalls of the locating plate and respectively defining therein a plurality of wire grooves for accommodating respective lead wires and two hook lugs respectively extended from respective free ends of the cover plates and adapted for hooking on the locating plate to secure the respective cover plates to the locating plate in a closed position. The male connector is connectable with the adapter portion of the connection housing, comprising a front housing defining a connection hole in a front end thereof for receiving the connection housing, a rear housing connected to an opposing rear side of the front housing for guiding the extending direction of lead wires and a lead wire tube mounted in the front housing and the rear housing and holding a plurality of lead wires therein for conduction with the respective lead wires in the adapter portion of the connection housing.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
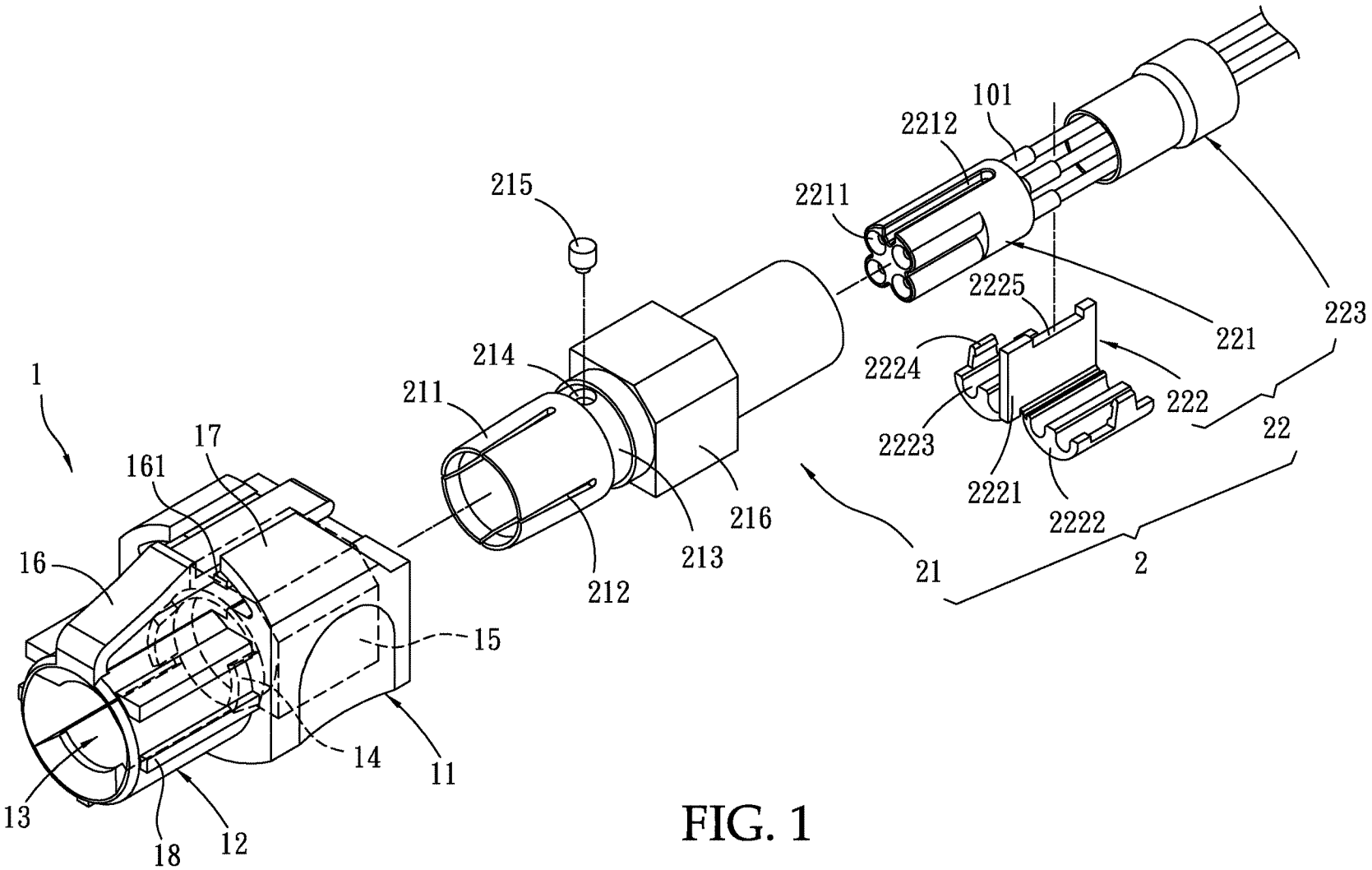
FIG. 1 is an exploded view of a connector module in accordance with a first embodiment of the present invention.

Referring to FIG. 1, a connector module in accordance with a first embodiment of the present invention is shown. The connector module of this first embodiment is a cable type design, comprising a connection housing 1 and a lead wire holder assembly 2.

Figure 2:
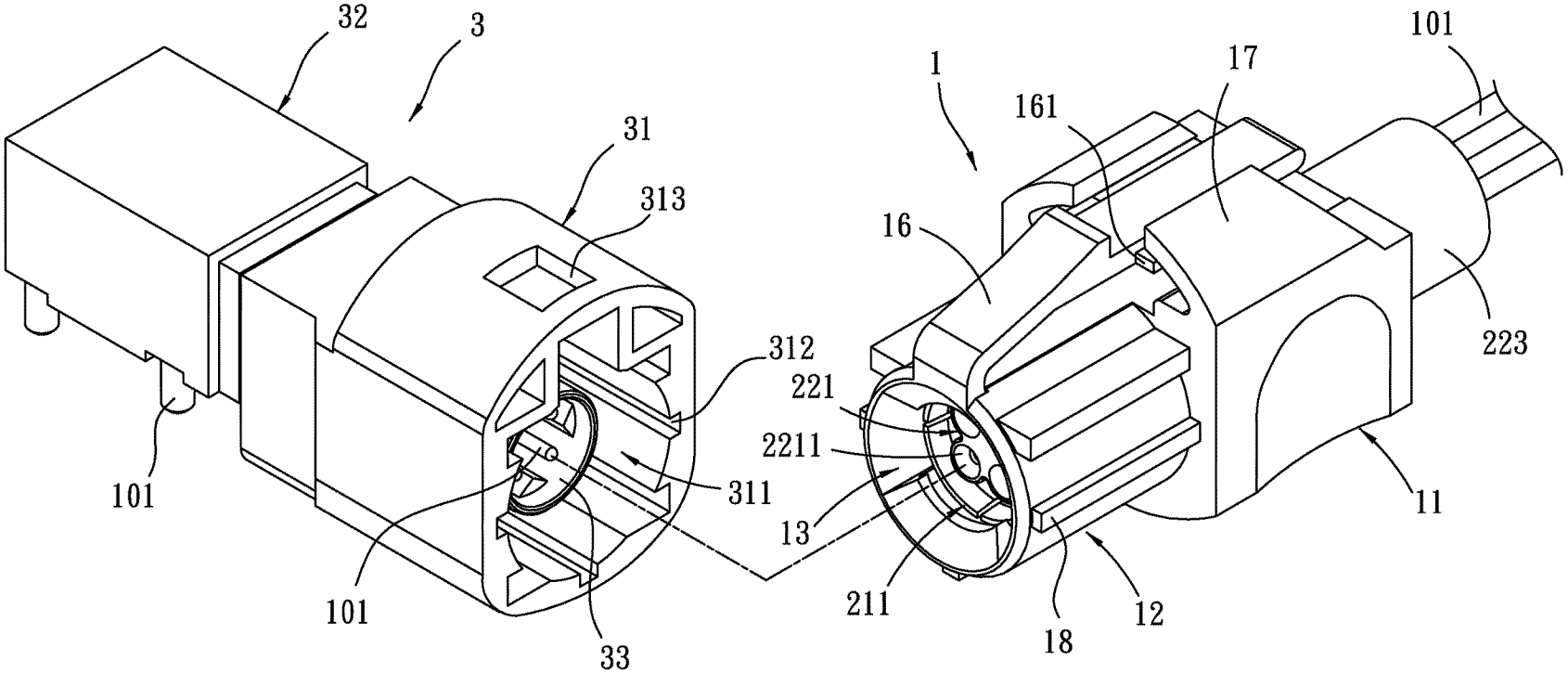
FIG. 2 illustrates the connection housing and lead wire holder assembly of the connector module of the first embodiment of the present invention assembled before connection with the mating male connector.

The lead wire holder assembly 2 has one end thereof inserted into the connection housing 1. As illustrated in FIG. 2, the connection housing 1 is a hollow shell. In this embodiment, the connection housing 1 is a female connector housing, comprising an adapter portion 11 located at a rear end thereof, a connection portion 12 located at an opposing front end thereof, a through slot 13 axially cut through the connection portion 12 and the adapter portion 11, a plurality of claws 14 symmetrically located at an inside wall of the adapter portion 11 adjacent to the connection portion 12 and respectively defining with the inside wall of the adapter portion 11 a predetermined contained angle, a retaining groove 15 located on the inside wall of the adapter portion 11 and exhibiting a rectangular profile, a clip 16 obliquely and backwardly extended from a front top side of the connection portion 12 toward the adapter portion 11 and having two side ribs 161 respectively located at two opposite lateral sides thereof and suspending above the adapter portion 11, two stop flanges 17 respectively extended from two opposite lateral sides of a top wall of the adapter portion 11 and respectively suspending above the side ribs 161 to limit the tilt angle of the clip 16, and a plurality of elongated coupling blocks 18 located at an outer wall of the connection portion 12.

Referring to FIG. 1 again, the lead wire holder assembly 2 comprises a holder shell 21 and a lead wire module 22. The holder shell 21 is inserted into the through slot 13 of the connection housing 1, comprising a guide tube 211 that is a split round tube having splits 212 symmetrically arranged in pairs to enhance the elasticity of the guide tube 211, an endless groove 213 extended around the outer perimeter of the guide tube 211, a through hole 214 located in the endless groove 213, a locating pin 215 mounted in the through hole 214, and a locating block 216 located on the guide tube 211. In this embodiment, the outer perimeter of the locating block 216 exhibits a substantially rectangular profile.

Referring to FIG. 1 again, the lead wire module 22 is inserted into the inside of the holder shell 21, comprising a locating seat 221 inserted into the guide tube 211. The locating seat 221 comprises a plurality of through slots 2211 for the insertion of respective lead wires 101, and a sliding groove 2212 longitudinally located on the periphery thereof. After insertion of the locating seat 221 into the guide tube 211, the sliding groove 2212 is disposed to face toward the through hole 214. Thus, the locating pin 215 in the through hole 214 is engaged into the sliding groove 2212 and stopped at an inner end of the sliding groove 2212 to stop the locating seat 221 in the guide tube 211 in position. The lead wire module 22 further comprises a wrapping block 222. The wrapping block 222 comprises a locating plate 2221 having an engagement groove 2225 located on a top side thereof, two cover plates 2222 of semi-circular cross section respectively hinged to two opposite sidewalls of the locating plate 2221 and respectively defining therein a plurality of wire grooves 2223 for accommodating respective lead wires 101, and two hook lugs 2224 respectively extended from respective free ends of the cover plates 2222 and adapted for hooking in the engagement groove 2225 to secure the respective cover plates 2222 to the locating plate 2221 in a closed position. The lead wire module 22 further comprises a barrel 223 adapted for holding the lead wires 101 in place in a spaced manner.

Referring to FIG. 2, the connection housing 1 is adapted for connecting to a mating male connector 3. The male connector 3 comprises a front housing 31, a rear housing 32 internally disposed in communication with the front housing 31, and a lead wire tube 33 longitudinally disposed in the front housing 31 and the rear housing 32 and holding therein a plurality of lead wires 101. When the front housing 31 and the connection portion 12 of the connection housing 1 are connected together, the lead wires 101 in the lead wire tube 33 are respectively conducted with the respective lead wires 101 in the respective through slots 2211. The front housing 31 comprises a connection hole 311 located in a front side thereof to expose the lead wire tube 33 and the related lead wires 101, a plurality of coupling grooves 312 located in an inside wall thereof within the connection portion 12 and adapted for receiving the respective elongated coupling blocks 18 upon insertion of the connection housing 1 into the front housing 31 of the male connector 3, and a broken hole 313 located at a top side thereof in communication with the connection hole 311 for engagement with the clip 16 upon insertion of the connection housing 1 into the front housing 31 of the male connector 3 to lock the connection housing 1 to the male connector 3. The rear housing 32 extends backward from the front housing 31, and adapted to hold the lead wire tube 33 and the related lead wires 101 in place and to guide their extending direction. In this embodiment, the rear housing 32 guides the respective lead wires 101 to extend downward for connection to an external circuit (not shown).

Figure 3:
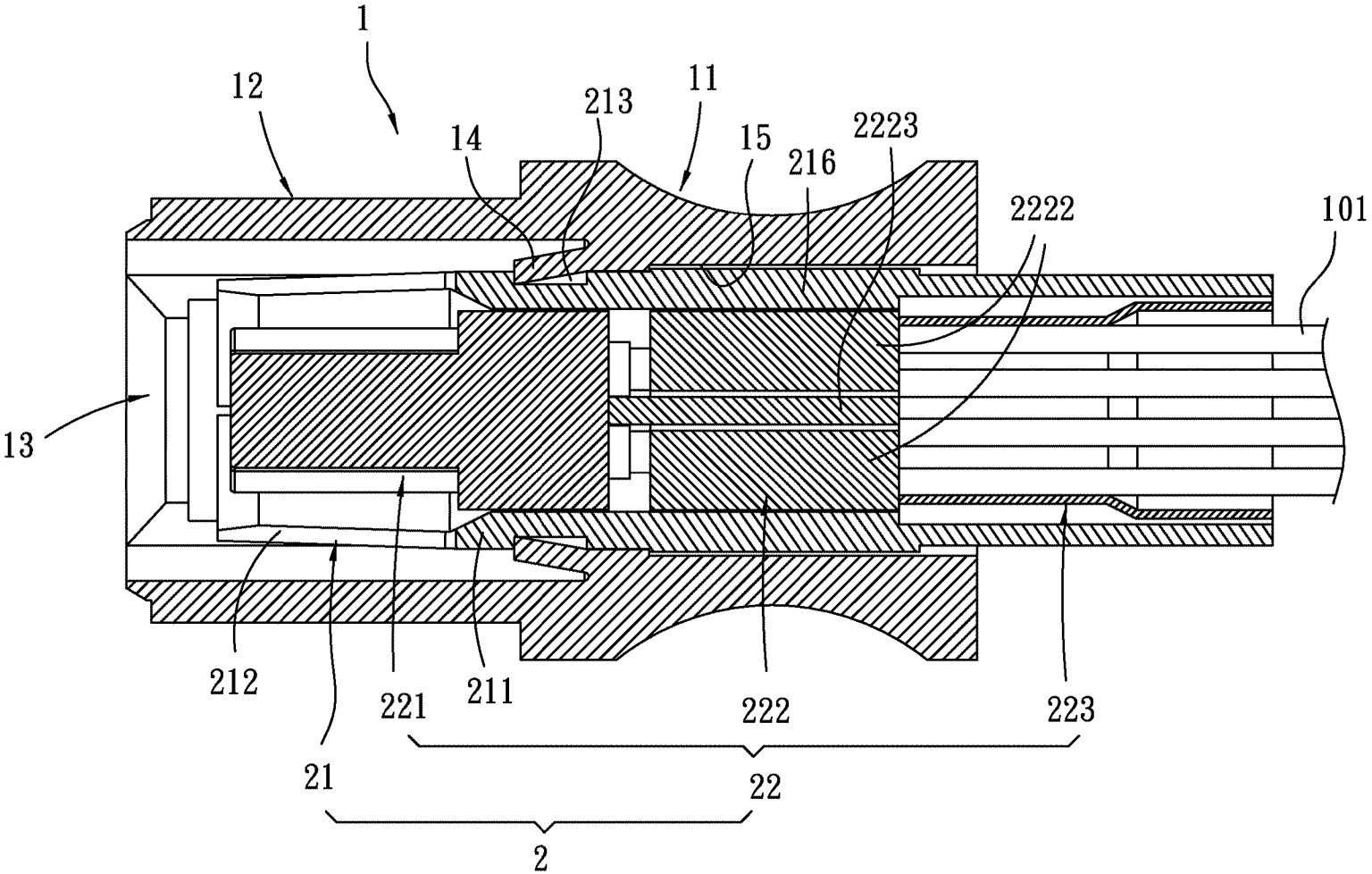
FIG. 3 is a sectional assembly view of the first embodiment of the present invention, illustrating the connection housing and the lead wire holder assembly assembled.
Figure 4:
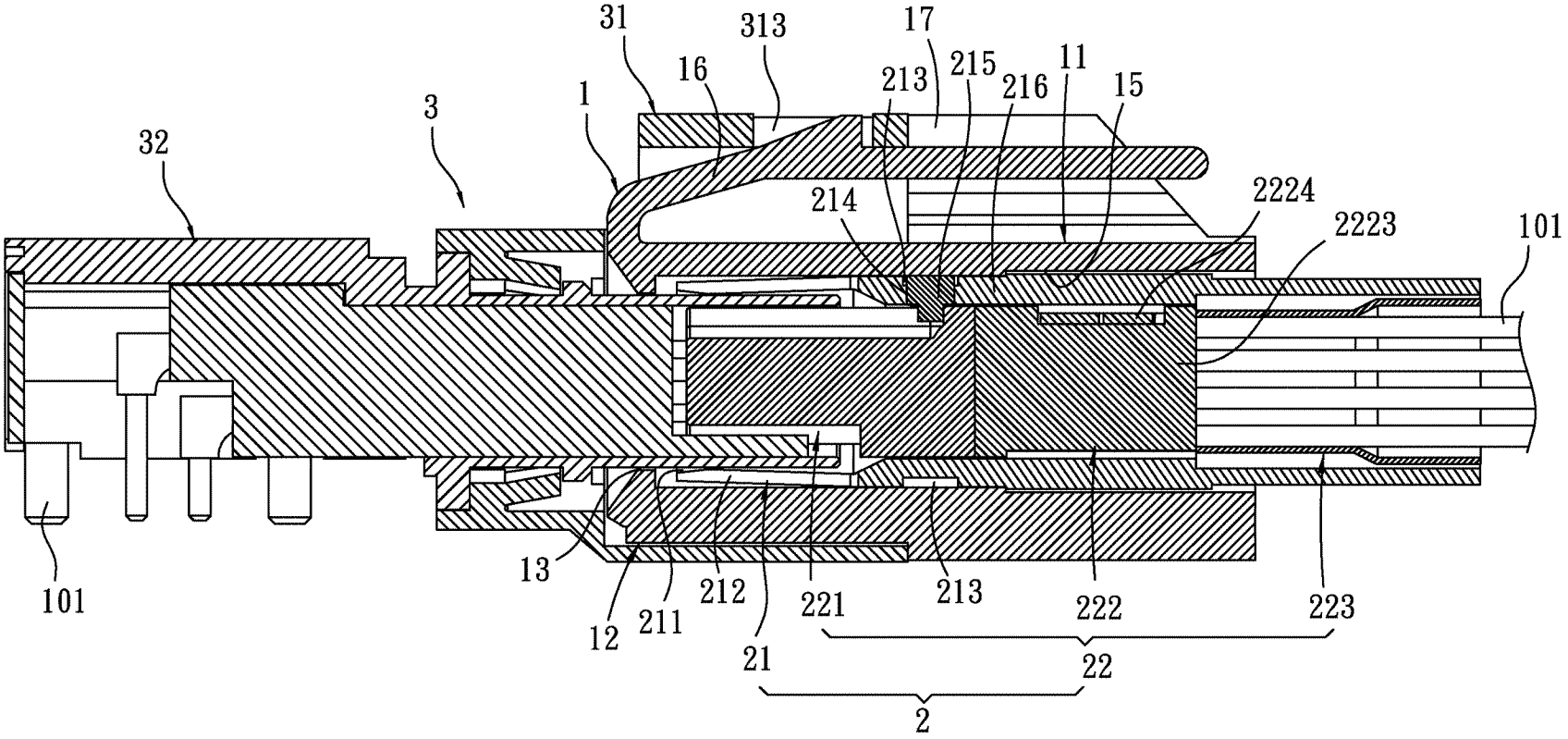
FIG. 4 is a sectional assembly view of the first embodiment of the present invention, illustrating the connection housing and the lead wire holder assembly assembled and connected with the mating male connector.

Referring to FIG. 3 and FIG. 4, the lead wire holder assembly 2 is inserted into the through slot 13 of the connection housing 1 and received inside the connection portion 12. At this time, the claws 14 in the connection housing 1 are respectively hooked in the endless groove 213 of the guide tube 211 and the locating block 216 is positioned in the retaining groove 15 to secure the connection housing 1 and the holder shell 21 together, and thus, the connection housing 1 and the lead wire holder assembly 2 are tightly secured together. As illustrated in FIG. 4, the locating pin 215 is plugged into the through hole 214 to lock the locating seat 221 to the guide tube 211. After connection between the connection housing 1 and the male connector 3, the lead wires 101 in the respective through slots 2211 of the locating seat 22 inside the holder shell 21 are electrically conducted with the respective lead wires 101 in the lead wire tube 33 of the male connector 3, and the clip 16 is engaged into the broken hole 313 to lock the connection housing 1 to the male connector 3.

Figure 5:
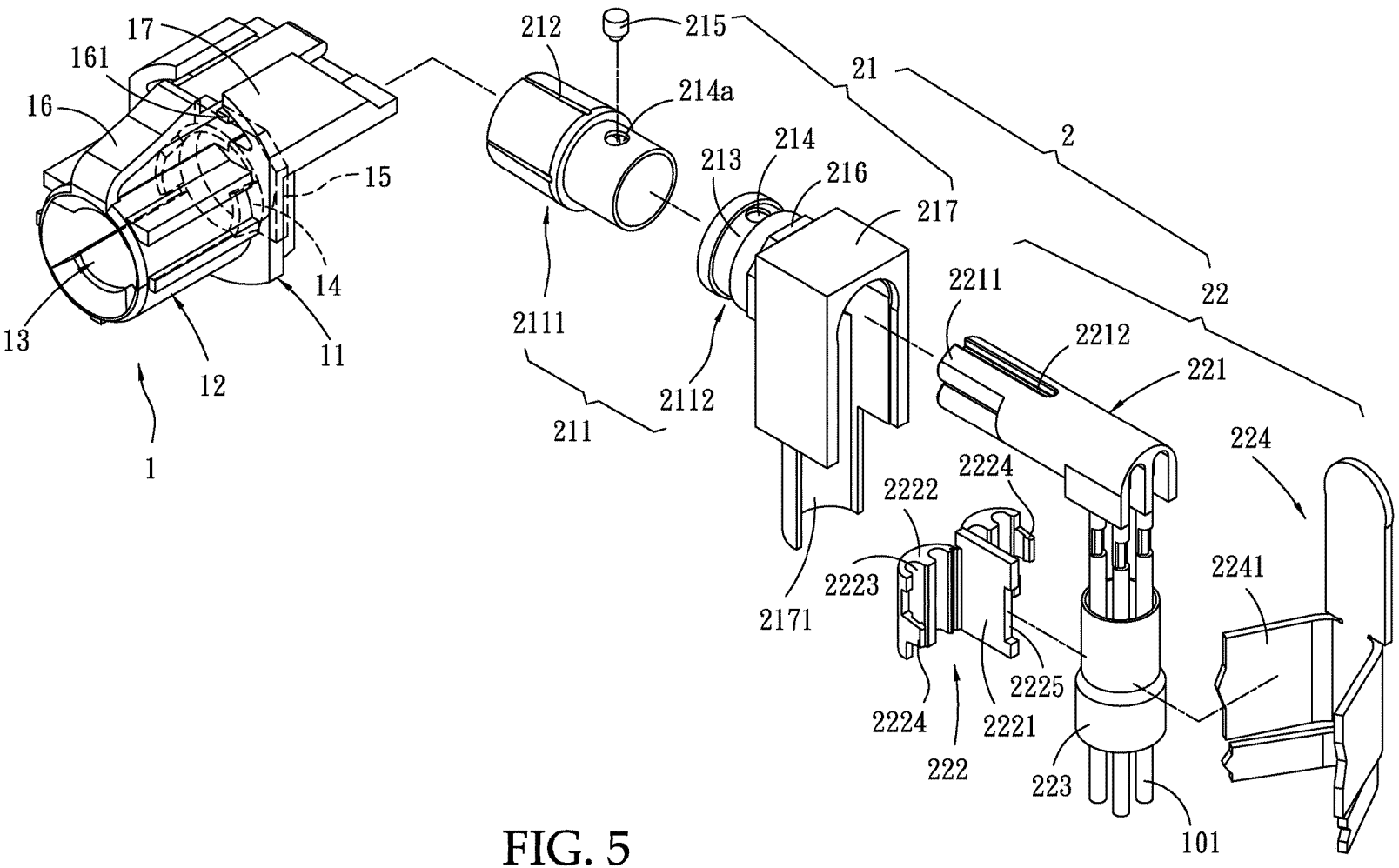
FIG. 5 is an exploded view of a connector module in accordance with a second embodiment of the present invention.
Figure 6:
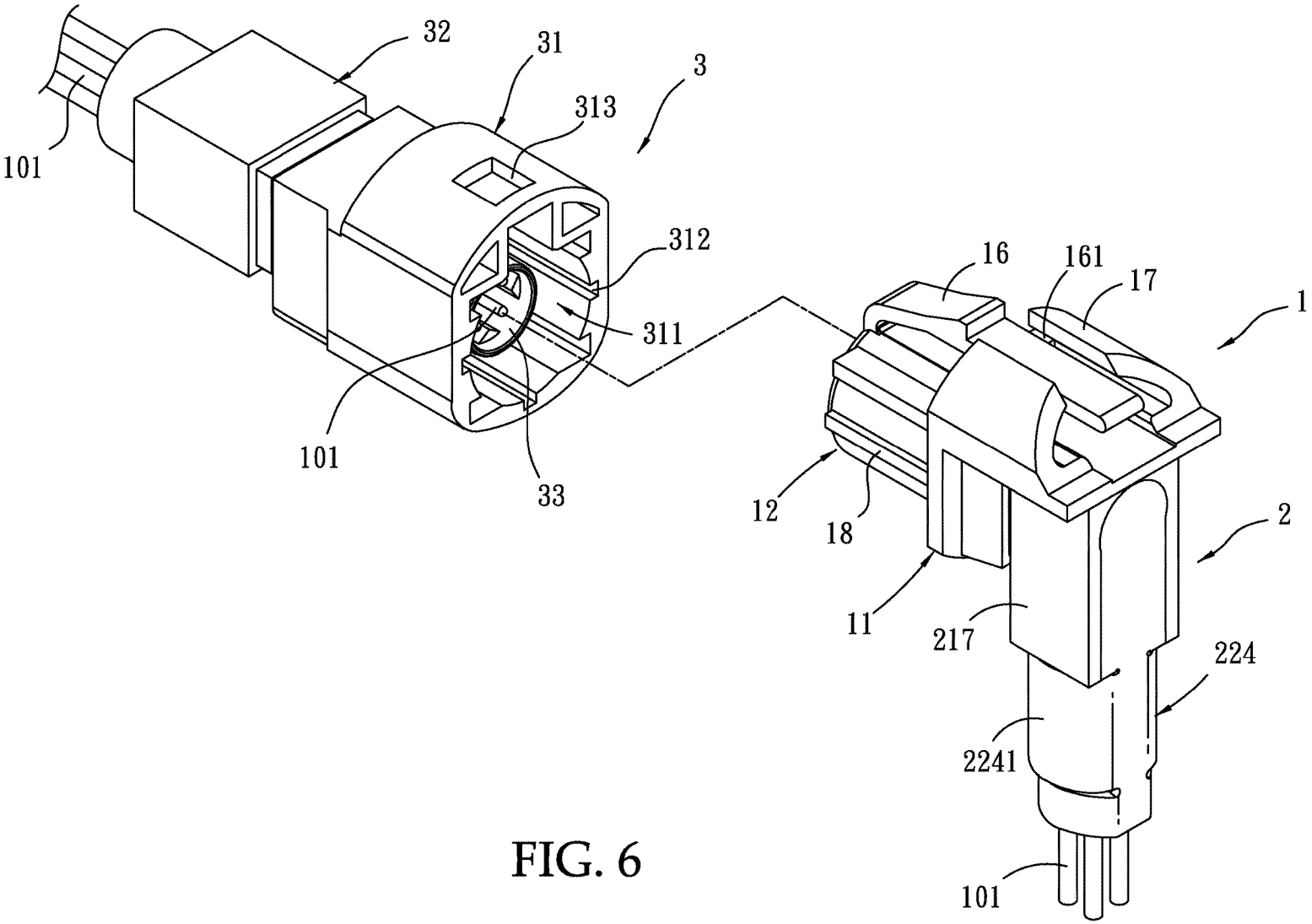
FIG. 6 illustrates the connection housing and lead wire holder assembly of the connector module of the second embodiment of the present invention assembled before connection with the mating male connector.

Referring to FIG. 5, a connector module in accordance with a second embodiment of the present invention is shown. The connector module of this second embodiment is a board-mount design, comprising a connection housing 1 and a lead wire holder assembly 2. The lead wire holder assembly 2 is inserted with one end thereof into the connection housing 1. As illustrated in FIG. 6, the connection housing 1 comprises an adapter portion 11 located at a rear end thereof, a connection portion 12 located at an opposing front end thereof, a through slot 13 axially cut through the connection portion 12 and the adapter portion 11, a plurality of claws 14 symmetrically located at an inside wall of the adapter portion 11 adjacent to the connection portion 12 and respectively defining with the inside wall of the adapter portion 11 a predetermined contained angle, a retaining groove 15 located on the inside wall of the adapter portion 11 and exhibiting a rectangular profile, a clip 16 obliquely and backwardly extended from a front top side of the connection portion 12 toward the adapter portion 11 and having two side ribs 161 respectively located at two opposite lateral sides thereof and suspending above the adapter portion 11, and two stop flanges 17 respectively extended from two opposite lateral sides of a top wall of the adapter portion 11 and respectively suspending above the side ribs 161 to limit the tilt angle of the clip 16.

As illustrated in FIG. 5, the lead wire holder assembly 2 comprises a holder shell 21 and a lead wire module 22. The holder shell 21 is inserted into the through slot 13 of the connection housing 1, comprising a guide tube 211 consisting of a first guide tube portion 2111 and a second guide tube portion 2112, a plurality of splits 212 longitudinally located on the first guide tube portion 2111 and symmetrically arranged in pairs to enhance the elasticity of the guide tube 211, an endless groove 213 extended around the outer perimeter of the second guide tube portion 2112, a through hole 214*a* located on the first guide tube portion 2111, a through hole 214 located in the endless groove 213 of the second guide tube portion 2112 in axial alignment with the through hole 214*a*, a locating pin 215 mounted in the through holes 214*a*;214, a locating block 216 located on the second guide tube portion 2112 adjacent to the endless groove 213 and exhibiting a substantially rectangular profile, a hollow mounting block 217 perpendicularly extended from one end of the second guide tube portion 2112 remote from the first guide tube portion 2111, and a guide plate 2171 downwardly extended from a bottom side of the hollow mounting block 217. Thus, subject to the arrangement of the mounting block 217 and the second guide tube portion 2112, the guide tube 211 exhibits an L-shaped profile.

Referring to FIG. 5 again, the lead wire module 22 is inserted into the inside of the holder shell 21. The lead wire module 22 comprises a locating seat 221 inserted into the guide tube 211.

The locating seat 221 comprises a plurality of through slots 2211 for the insertion of respective lead wires 101, and a sliding groove 2212 longitudinally located on the periphery thereof. After insertion of the locating seat 221 into the guide tube 211, the sliding groove 2212 is disposed to face toward the through hole 214. Thus, the locating pin 215 in the through holes 214*a*;214 is engaged into the sliding groove 2212 and stopped at an inner end of the sliding groove 2212 to stop the locating seat 221 in the guide tube 211 in position. The lead wire module 22 further comprises a wrapping block 222. The wrapping block 222 comprises a locating plate 2221 having an engagement groove 2225 located on a top edge thereof, two cover plates 2222 of semi-circular cross section respectively hinged to two opposite sidewalls of the locating plate 2221 and respectively defining therein a plurality of wire grooves 2223 for accommodating respective lead wires 101, and two hook lugs 2224 respectively extended from respective free ends of the cover plates 2222 and adapted for hooking in the engagement groove 2225 to secure the respective cover plates 2222 to the locating plate 2221 in a closed position. The lead wire module 22 further comprises a barrel 223 disposed perpendicular to the locating seat 221 and adapted for holding the lead wires 101 in place in an angled shape. The lead wire module 22 further comprises a shield 224 exhibiting a substantially ⊓-shaped profile and fastened to the mounting block 217 and the guide plate 2171 to hold the respective lead wires 101 in place in a spaced manner. The shield 224 comprises two hinge plates 2241 located at two opposite lateral sides thereof, facilitating installation. The lead wire module 22 further comprises a barrel 223 adapted for holding the lead wires 101 in place in a spaced manner.

Referring to FIG. 6, the connection housing 1 of the connector module in accordance with the second embodiment of the present invention is adapted for connecting to a mating male connector 3. The male connector 3 comprises a front housing 31, a rear housing 32 internally disposed in communication with the front housing 31, and a lead wire tube 33 longitudinally disposed in the front housing 31 and the rear housing 32 and holding therein a plurality of lead wires 101. When the front housing 31 and the connection portion 12 of the connection housing 1 are connected together, the lead wires 101 in the lead wire tube 33 are respectively conducted with the respective lead wires 101 in the respective through slots 2211. The front housing 31 comprises a connection hole 311 located in a front side thereof to expose the lead wire tube 33 and the related lead wires 101, a plurality of coupling grooves 312 located in an inside wall thereof within the connection portion 12 and adapted for receiving the respective elongated coupling blocks 18 upon insertion of the connection housing 1 into the front housing 31 of the male connector 3, and a broken hole 313 located at a top side thereof in communication with the connection hole 311 for engagement with the clip 16 upon insertion of the connection housing 1 into the front housing 31 of the male connector 3 to lock the connection housing 1 to the male connector 3. The rear housing 32 extends backward from the front housing 31, and adapted to hold the lead wire tube 33 and the related lead wires 101 in place and to guide their extending direction. In this embodiment, the rear housing 32 guides the respective lead wires 101 to extend backward for connection to an external circuit (not shown).

Figure 7:
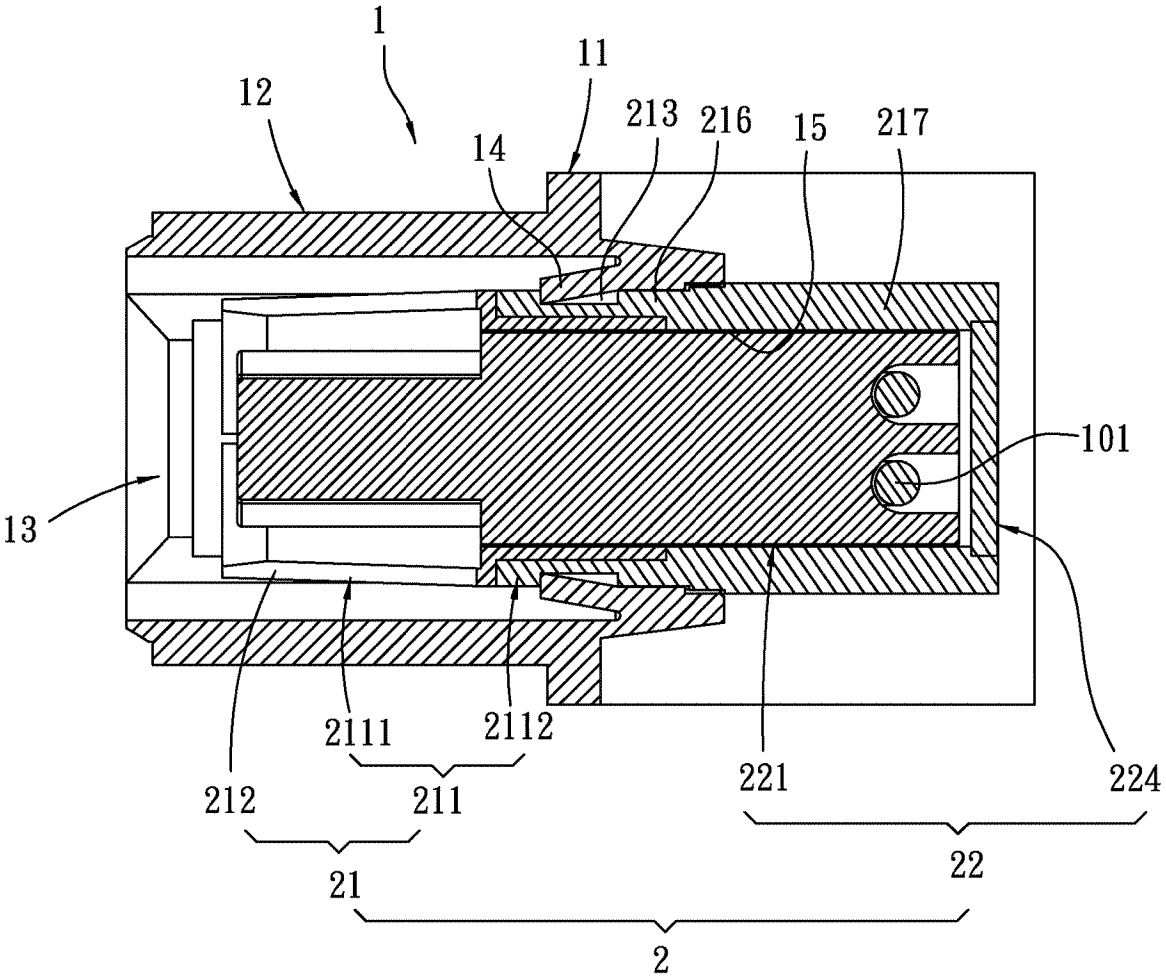
FIG. 7 is a sectional assembly view of the second embodiment of the present invention, illustrating the connection housing and the lead wire holder assembly assembled.
Figure 8:
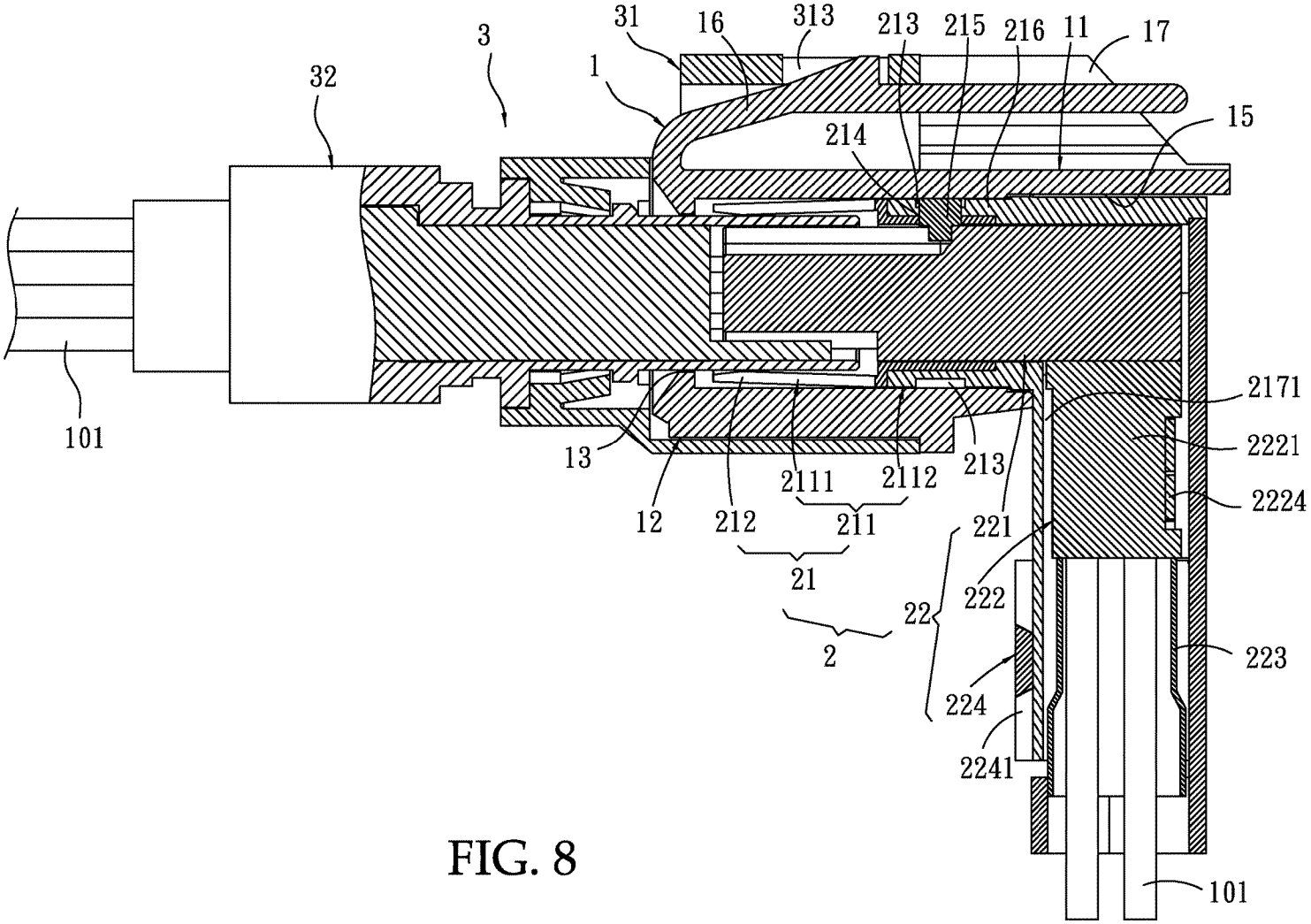
FIG. 8 is a sectional assembly view of the second embodiment of the present invention, illustrating the connection housing and the lead wire holder assembly assembled and connected with the mating male connector.

Referring to FIGS. 7 and 8, the lead wire holder assembly 2 is inserted into the through slot 13 of the connection housing 1 and received inside the connection portion 12. At this time, the claws 14 in the connection housing 1 are respectively hooked in the endless groove 213 of the guide tube 211 and the locating block 216 is positioned in the retaining groove 15 to secure the connection housing 1 and the holder shell 21 together, and thus, the connection housing 1 and the lead wire holder assembly 2 are tightly secured together. As illustrated in FIG. 8, the locating pin 215 is plugged into the through holes 214*a*;214 to lock the locating seat 221 to the guide tube 211.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A connector module, comprising:

a connection housing comprising a through slot axially cut through opposing front and rear sides thereof, an adapter portion located at the rear side around said through slot, a plurality of claws spaced around an inside wall of said adapter portion and respectively defined with the inside wall of said adapter portion a predetermined contained angle, and a retaining groove located on the inside wall of said adapter portion;

a lead wire holder assembly inserted into said through slot of said connection housing, said lead wire holder assembly comprising a holder shell and a lead wire module inserted into said holder shell, said holder shell comprising a guide tube, said guide tube comprising an endless groove extended around the periphery thereof and forced into engagement with said claws of said connection housing and a locating block located thereon adjacent to said endless groove and positioned in said retaining groove of said connection housing, said lead wire module comprising a locating seat inserted into said guide tube, said locating seat comprising a plurality of longitudinally extended through slots adapted for holding respective lead wires, a wrapping block comprising a locating plate, two cover plates respectively hinged to two opposite sidewalls of said locating plate and respectively defining therein a plurality of wire grooves for accommodating respective lead wires and two hook lugs respectively extended from respective free ends of said cover plates and adapted for hooking on said locating plate to secure the respective said cover plates to said locating plate in a closed position; and a male connector connectable with said adapter portion of said connection housing, said male connector comprising a front housing defining a connection hole in a front end thereof for receiving said connection housing, a rear housing connected to an opposing rear side of said front housing for guiding the extending direction of lead wires and a lead wire tube mounted in said front housing and said rear housing and holding a plurality of lead wires therein for conduction with the respective said lead wires in said adapter portion of said connection housing.

2. The connector module as claimed in claim 1, wherein said retaining groove exhibits a rectangular profile.

3. The connector module as claimed in claim 2, wherein said locating block exhibits a rectangular profile fitting said retaining groove.

4. The connector module as claimed in claim 1, wherein said connection housing further comprises a clip obliquely and backwardly extended from a front top side thereof, two side ribs respectively located at two opposite lateral sides of said clip, and two stop flanges respectively extended from two opposite lateral sides of a top wall of said adapter portion and respectively suspending above said side ribs of said clip to limit the tilt angle of said clip.

5. The connector module as claimed in claim 4, wherein said front housing of said male connector comprises a broken hole located on a top side thereof for the engagement of said clip of said connection housing.

6. The connector module as claimed in claim 1, wherein said guide tube is a round tube.

7. The connector module as claimed in claim 1, wherein said guide tube comprises a plurality of splits longitudinally located on one end thereof and symmetrically arranged in pairs.

8. The connector module as claimed in claim 1, wherein said holder shell further comprises a through hole located in said endless groove, a locating pin mounted in said through hole for securing said locating seat to said holder shell.

9. The connector module as claimed in claim 8, wherein said locating seat comprises a sliding groove longitudinally located on a top side thereof and adapted for receiving said locating pin to secure said holder shell and said lead wire module together after insertion of said locating seat into said guide tube.

10. The connector module as claimed in claim 1, wherein said cover plates have a semi-circular cross section.

11. The connector module as claimed in claim 1, wherein said locating plate comprises an engagement groove located on a top edge thereof for securing said hook lugs of said cover plates.

12. The connector module as claimed in claim 1, wherein said lead wire module further comprises a barrel adapted for holding the inserted said lead wires in place.

13. The connector module as claimed in claim 1, wherein said guide tube further comprises a hollow mounting block perpendicularly extended from a rear end thereof, and a guide plate downwardly extended from a bottom side of said hollow mounting block.

14. The connector module as claimed in claim 13, wherein the combination of said mounting block and said guide plate exhibits an L-shaped profile.

15. The connector module as claimed in claim 13, wherein said lead wire module further comprises a shield covered on said mounting block and fastened to said guide plate to hold the respective said lead wires in place.

16. The connector module as claimed in claim 15, wherein said shield exhibits a substantially ⊓-shaped profile.

17. The connector module as claimed in claim 12, wherein said shield comprises two hinge plates located at two opposite lateral sides thereof for mounting.

* * * * *